US009341447B2

(12) United States Patent
James

(10) Patent No.: US 9,341,447 B2
(45) **Date of Patent: *May 17, 2016**

(54) ARROW TIP MOUNTING APPARATUS AND METHOD

(71) Applicant: Brian James, El Cajon, CA (US)

(72) Inventor: Brian James, El Cajon, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/337,107

(22) Filed: Jul. 21, 2014

(65) Prior Publication Data

US 2014/0329625 A1 Nov. 6, 2014

Related U.S. Application Data

(63) Continuation-in-part of application No. 13/932,944, filed on Jul. 1, 2013, now Pat. No. 8,784,243, which is a continuation of application No. 13/096,972, filed on Apr. 28, 2011, now Pat. No. 8,475,303.

(60) Provisional application No. 61/328,771, filed on Apr. 28, 2010.

(51) Int. Cl.
*F42B 6/08* (2006.01)
*F42B 6/04* (2006.01)

(52) U.S. Cl.
CPC .... *F42B 6/04* (2013.01); *F42B 6/08* (2013.01)

(58) Field of Classification Search
CPC ..... F42B 6/04; F42B 6/06; F42B 6/08
See application file for complete search history.

(56) References Cited

U.S. PATENT DOCUMENTS

| | | | | |
|---|---|---|---|---|
| 4,534,568 | A * | 8/1985 | Tone | 473/583 |
| 4,671,517 | A * | 6/1987 | Winters | 473/583 |
| 7,115,055 | B2 * | 10/2006 | Palomaki et al. | 473/578 |
| 7,651,421 | B2 * | 1/2010 | Smith et al. | 473/582 |
| 8,057,330 | B2 | 11/2011 | Blosser et al. | |
| 8,475,303 | B2 * | 7/2013 | James | 473/582 |
| 8,784,243 | B2 * | 7/2014 | James | 473/582 |
| 2009/0163308 | A1 * | 6/2009 | Odabachian et al. | 473/582 |

OTHER PUBLICATIONS

Browning Archery, Catalog, Dec. 1990, pp. 24-27, USA.
Browning 1992 Archery Products, Catalog, Sep. 1991,pp. 24-27, USA.

* cited by examiner

*Primary Examiner* — John Ricci
(74) *Attorney, Agent, or Firm* — Donn K. Harms

(57) ABSTRACT

An interface component for engaging an arrow tip to the leading end of an arrow shaft. The device directs impact forces axially and eliminates the shearing and wall collapse of arrow shafts caused by conventional collared arrow head engagement devices which tend to collapse and cut the leading edge of arrow shafts on hard impacts. Engagement to the arrow shaft leading end is provided by an elongated member axially engaged with the bore of the arrow shaft. The exterior surface of the device can be surfaced to interact with passing air during flight of the arrow and increase spin for better accuracy.

20 Claims, 4 Drawing Sheets

ARROW TIP MOUNTING APPARATUS AND METHOD

This application is a continuation-in-part of U.S. patent application Ser. No. 13/932,944 filed on Jul. 1, 2013(now allowed), which is a claims priority to U.S. patent application Ser. No. 13/096,972 filed on Apr. 28, 2011 (now U.S. Pat. No. 8,475,303) all incorporated herein in entirety by this reference.

FIELD OF INVENTION

The present invention relates generally to archery. More particularly, the disclosed method and apparatus relate to an improved system for the engagement of arrow tips to modern carbon fiber and synthetic arrow shafts.

BACKGROUND OF THE INVENTION

Archery has been employed by mankind for thousands of years for both sport and combat. Modernly, archery has evolved in recent decades to employ technically advanced bows and highly engineered arrows.

Modern arrows are made of elongated rods or tubes of stiff, low density material such as wood, fiberglass, aluminum, carbon fiber, or a composite of carbon fiber wrapped around aluminum tubing. Such materials yield a strong and substantially rigid projectile for the archer.

While arrows are designed to be very stiff, in practice, they still must retain the ability to flex or bend. Consequently, synthetically formed arrows, such as those made from carbon fiber and resin, have become ever more popular because they provide both stiffness and the ability to flex when fired from the bow.

Arrows modernly employ a shaft which is formed of a tube having an axial passage therethrough. This is because, for a given mass in flight, tubes have been found to be stiffer than solid rods. Additionally affecting aerodynamics is the diameter of the tube employed. Generally speaking, it has been shown that larger diameter tubes with thin walls are inherently stiffer. However, these larger diameter tubes are also mechanically weaker than narrow thick walled tubes, and the smaller the diameter of the shaft, the more aerodynamic the resulting arrow. Consequently, the material forming the tube itself can help solve the dilemma of which diameter to employ.

Because carbon fiber is inherently stiffer and lighter than aluminum, when employed in an arrow shaft, it allows the arrow shaft overall diameter to be thinner than arrows manufactured in earlier years and therefore more aerodynamic. Further, carbon fiber is lighter, yet has excellent stiffness and as a consequence, an arrow released from a bow which has a carbon fiber shaft will generally accelerate to a higher velocity than the larger cross-section heavier arrows of the past. As a consequence, the sport of archery has come to favor carbon fiber arrow shafts as a preferred construction for the arrows in an archer's quiver. Such carbon fiber or carbon fiber surrounding aluminum arrow shafts proved for a lightweight, stiff and durable arrow, when fired at the high velocities provided by modern bows.

One such carbon fiber designed arrow is the VICTORY ARMOUR PIERCING arrow which is widely employed. While well received in the archery community for the high velocity it achieves with concurrent accuracy, this arrow, like many recently engineered and formed of carbon fiber, suffers from breakage when the arrowhead and carbon fiber shaft impacts a target. This is especially true if fired from a bow capable of projecting the arrow at especially high velocity speeds.

The vast majority of archers have chosen to continue to employ their conventional target and hunting arrowheads whether engaged to larger diameter conventional arrow shafts or the more modern carbon fiber arrow shafts. Because the diameter of the carbon fiber shafts is narrower than previous conventional arrow shafts, the hollow axial conduit running through them is also narrowed. Conventional arrowheads, in use and currently sold, provide a threaded rear shaft for the arrowhead, which is designed to engage the threaded axial passage of arrow shafts having the larger diameter, and not the more modern carbon fiber arrow shafts. As a consequence, engagement tips have been provided by carbon fiber manufacturers which allow for the engagement of conventional arrow head threaded shafts to carbon fiber arrows. Such engagement tips, conventionally employ on a first end, a rearward facing collar sized for an adhesive engagement surrounding the exterior circumference of the carbon fiber arrow at its distal end. On the opposite end is a threaded aperture running into an axial conduit.

Carbon fiber arrow shafts employing this engagement tip however have shown a propensity, upon striking a target, to bend at the collar affixed to the leading end of the arrow. Because this collar is used to attach the metal point or tip of the arrowhead to the front of the arrow, and to allow changes in weight and type of arrowhead, the breaking of the collar and resulting damage to the arrow shaft destroys the functionality of the carbon fiber arrow.

Such conventional collar style tips are generally formed of metal, such as aluminum. On the end opposite the arrow shaft engaging collar, is the threaded axial passage to engage the threaded shaft of an arrowhead or tip leading from such a threaded shaft. Another problem that occurs frequently, but is just as vexing since it destroys the carbon fiber arrow functionality, is the propensity of the engaging shaft of the arrowhead, to bend or break at its enlargement with the collar mounted tip.

As noted, the current conventional mode for engaging the arrowhead engagement tip to the leading edge of carbon fiber arrows such as the VICTORY ARMOUR PIERCING arrow and similar conventional carbon fiber arrows, is to employ a metal collar to engage on and surround the exterior circumference of the carbon fiber arrow shaft. This collar is conventionally glued permanently upon the shaft or may be compressibly engaged about the outside circumference of the arrow's leading end.

The collar so glued, or wedged or compressed around the exterior surface of the leading edge of the shaft, is thus permanently engaged. Damage to the collar results in damage to the arrow shaft from shearing and bending because the force from a hard impact of the arrow is communicated to a very small exterior portion of the wall of the arrow shaft. Damage to the delicately sized and balanced carbon fiber shaft, renders the arrow unuseable. This is because archers conventionally cut their arrows to their personal length preference for drawing on their bow, and a sheared or broken shaft would need to be cut shorter for use. Further, once the collar breaks and/or shears or bends the end of the carbon fiber arrow, the weight of the arrow and balance is also compromised.

Furthermore, archers have chosen to employ arrow heads having standardized threaded shafts with standardized diameters for engaging to the leading edge of larger arrows or the new smaller cross-sectioned carbon fiber arrows, regardless of the arrow shaft diameter. As such it is undesirable for manufacturers to produce new and consequently smaller engagement tips with smaller axial threaded passages for arrowhead engagement as it would be at great cost to hundreds of thousands of archers who already own arrow tips having a standard diameter engaging threaded shaft.

Accordingly, there exists an unmet need for a device and method which enables archers to engage their standardized arrow heads upon narrowed cross sectioned carbon fiber arrows to take advantage of the high velocities and aerodynamics achievable using such carbon fiber arrow shafts, without the fear of the arrow being destroyed on impact. Such a device should be easily engageable to the leading end of existing configurations of carbon fiber arrow shafts. Further, such a device should provide such a strong mount of the arrow head to the leading end of a carbon fiber arrow shaft, so as to allow for the employment of even higher arrow velocities in the future, without fear of breaking the arrow shaft on impact. Still further, such a device should allow archers to adjust the balance and weight of the assembled arrow easily, and should enhance rather than impair the impartation of spin to the arrow leaving the bow to increase accuracy.

With respect to the above, before explaining at least one preferred embodiment of the device and method for engagement of arrow tips to carbon fiber and other synthetic arrow shafts, it is to be understood that the invention herein is not limited in its application as depicted or taught and to the details of construction and to the arrangement of the components or steps set forth in the following description or illustrated in the drawings. The various apparatus and methods of the invention are capable of other embodiments and of being practiced and carried out in various ways, all of which will be obvious to those skilled in the art, once they review this disclosure. Also, it is to be understood that the phraseology and terminology employed herein are for the purpose of description and should not be regarded as limiting in any fashion whatsoever.

As such, those skilled in the art will appreciate that the conception upon which this disclosure is based, may readily be utilized as a basis for designing of other devices, methods and systems for carrying out the several purposes of the herein disclosed carbon fiber arrow shaft engagement for arrow points and weights. It is important, therefore, that the objects and claims be regarded as including such equivalent construction and methodology insofar as they do not depart from the spirit and scope of the present invention.

SUMMARY OF THE INVENTION

The disclosed device and method of employment herein, is directed to an arrow point or arrowhead engagement mount configured for a permanent engagement at the leading end of a carbon fiber or other synthetic arrow shaft such as the Victory Archery NANOFORCE arrow. Rather than the conventional circumference-engaging collar, the device herein employs an elongated rearward projecting shaft for engagement with the axial bore at the leading end of a carbon fiber arrow shaft. The shaft of the device, is configured with an exterior circumference equal to or slightly smaller than the interior circumference of the axial bore of such carbon fiber arrows. The shaft may vary in length to adjust for weight and balance of the assembled arrow and may also have means to engage extensions to the shaft to further balance the arrow or add mass to the impact end.

Engagement of the elongated shaft within the axial bore of the arrow shaft, is currently achieved using adhesive in between the surfaces of the arrow shaft and the exterior of the elongated member. However, a frictional engagement or mechanical engagement such as a threaded elongated shaft engaging the interior wall of the axial bore of the carbon fiber shaft might also be employed. However, the current preferred mode of engagement is employing an elongated shaft having a diameter to yield a shaft circumference slightly smaller than the diameter of the circumference of the axial bore of such carbon fiber arrows along with an epoxy or other adhesive.

It is known that archers desire specific arrow tip weights and it is therefor particularly preferred that the elongated shaft be adjustable in weight. This is provided by either having a shaft which may be cut to a shorter length, or a means to provide for the addition of added mass by engagement to the trailing distal end of the shaft. In one preferred mode, additional portions of the shaft may be engaged to the trailing distal end of the elongated shaft employing a threaded engagement as a means for engagement of the portions to the shaft. For example the trailing end of the elongated shaft, opposite the engagement end for the shaft of the arrowhead, can include an axial cavity with threaded interior walls for receiving and threadably engaging with an additional shaft portion to allow the user to add weight. The additional shaft portion may be of the same metal as the shaft or may be other heavier metals such as bronze or lead if mass enhancement is desired.

The elongated shaft of the device herein, extends from one end of the body of the device. The first end of the body or a shoulder portion has a diameter and resulting exterior circumference which is larger than the exterior circumference of the elongated shaft, and substantially equal to the exterior circumference of the arrow shaft. In this manner the rear edge of the shoulder from which the elongated shaft projects, limits the distance into the axial bore the elongated shaft will extend.

Further the combination mount of the engaged elongated engagement shaft following the axial bore of the arrow, and the shoulder abutting the end of the arrow, provides a means to maintain engagement of the mounting tip to the arrow shaft without damage on impact at high velocity. The stabilizing effect of the elongated engagement shaft extending rearward of the first end or shoulder portion, and the impact communication of the shoulder to the front of the arrow shaft, communicates the force imparted by an impact substantially evenly to the wall forming the arrow shaft and along the line of the axis of the arrow shaft. This even and straight force transmission avoids the rotation and shear damage suffered by conventional collared engagements to the exterior of carbon fiber arrows which rely on the extremely short collar only and adhesive. In collared devices, the severe forces from a hard impact are communicated to a very small area and because of the short distance of the collar along the exterior of the wall forming the arrow shaft. This results in too much force at a small area and the short collar having no leverage to avoid a rotation of the collar or movement traverse to the axis of the arrow shaft, communicates a force that causes wall collapse or shear damage to the wall of the arrow shaft when the collar rotates traverse to the axis and dismounts.

At the opposite end of the shoulder portion of the mount, from the communication with the arrow shaft, an axial passage is formed within the mount and communication therewith is provided by an aperture on the leading end of the mount opposite the extending shaft. In one mode, a first portion of the axial passage from the aperture access to a mid point is smooth walled. A second portion aft of the smooth walled portion has a wall surface with threads formed thereon. In a second mode, the threads may extend the entire length from the aperture along the axial passage. In all modes, the threads are configured to operatively engage matching threads formed on the mounting shaft extending from the mount for or from an arrowhead or arrow tip. In this fashion, the arrowhead, engaged to the engagement shaft, may be threadably attached to the leading edge of the carbon fiber arrow shaft and removably engaged with the mount provided by the device herein. The distal end of the conventional enlargement shaft, having a cross section too large to traverse the axial bore of the arrow shaft, remains forward of the front of the arrow shaft, engaged in the axial passage of the mount herein. This allows archers with millions of conventional arrowheads in use having such large engagement shaft extending therefrom, to engage their conventional arrowheads to smaller diameter carbon fiber arrows.

In a particularly preferred configuration of the disclosed mount herein, the exterior diameter from the shoulder portion to a mid portion of the mount, between the aperture at the front and the shoulder abutting the arrow shaft at the rear, is the same diameter as the engaged arrow shaft exterior. Thus, the exterior circumference of the arrow shaft matches that of the rear of the mount to the midpoint. From this midpoint forward to the leading edge of the mount, the exterior circumference tapers outwardly at a substantially even rate to form a tapered leading end portion of the mount which tapers from a widest point at the intersection of exterior circumference and the aperture access, to a narrowest diameter substantially the same as the engaged arrow shaft diameter.

This mode of the disclosed device provides great utility in that the archer may employ the rear portion of the shoulder portion of the mount for supporting the arrow on the bow. This is because the rear portion of the shoulder, in this mode, is the same diameter as the engaged arrow shaft. Thus, the archer is permitted to pull the arrow further rearward when drawing the arrow on the bow then if the entire mount tapered from the rear edge to the front edge. This extra portion for supporting the front of the arrow is desirous to many archers and will allow for a smooth transition of the arrow from the bow as opposed to a taper along the entire mount which might tend to shift the arrow upward as it comes in contact with the bow. Some archers, however, do not draw the arrow rearward far enough and for them a second mode of the device herein is provided. However, in both modes, the taper to a larger leading diameter of the mount provides a leading edge which on contact with the rear of an arrowhead or mount, is substantially the same diameter as the rear of the arrowhead or mount. This even and smooth transition of the respective circumferential surfaces provides better aerodynamics for the assembled arrow, especially during high speed flight where small aberrations in the surface will cause large variations in flight path and distance.

Currently, a preferred taper or angle of the exterior of the mount from the middle portion to the leading end, or from the rear edge of the shoulder portion to the leading end, is between 2.5 to 3.5 degrees from an imaginary line leading from the engaged arrow shaft exterior surface forward. However, this taper may be adjusted to accommodate tips and weights which may have larger or smaller rear ends, or longer or shorter leading portions, forward of the mounting shaft which engages the axial bore of the arrow shaft so as to form the smooth transition of the exterior circumference rear of the mount or arrowhead, and improved aerodynamics.

In another particularly preferred configuration the taper or angle of the exterior of the mount extends the entire length of the distance from the shoulder abutting the arrow shaft to the leading end. This configuration provides an added adjustment of weight compared to the first mode of taper or angle from only the middle portion to the leading end. For users who do not desire the utility of extra draw length provided by the concentric rear end of the mount and arrow shaft circumference, the increased mass may be desirable. In both modes, the rearward angled surface from the smooth transition of the circumferential surfaces of the arrowhead and the disclosed device, aid in accuracy and distance of the fired arrow.

In another mode of the device, the angled portion of the exterior of the mount herein, may be fluted, or beveled, or otherwise surfaced to react with passing air, and aid in imparting spin to the arrow during flight. Currently only the rear portion of the arrow shaft has flutes adapted to impart stabilizing spin to the flying arrow. Consequently imparting spin at the leading edge of the assembled arrow will aid in rendering spin to the arrow during flight.

The foregoing has outlined, rather broadly, the more pertinent and important features of the mount for an arrow tip engaged upon a carbon fiber or similar arrow shaft herein, in order that the detailed description of the invention that follows may be better understood and so that the present contribution to the art may be more fully appreciated. It should be appreciated by those skilled in the art that the conception, and the disclosed specific embodiments herein, may of course be readily utilized as a basis for providing other synthetic or carbon fiber arrow shaft tip mounts to carry out the same purposes of the present invention. It should also be realized by those skilled in the art that such equivalent systems and methods are considered within the spirit and scope of the invention as set forth herein.

THE OBJECTS OF THE INVENTION

It is therefore an object of the present invention to provide an arrow tip mount, for tips and arrowheads to a carbon fiber arrow shaft, which prevents breaking of the shaft on impact with a target.

An additional object of this invention is to provide such a tip mount, that is aerodynamic using a tapered exterior to communicate between the arrow shaft exterior and the rear of the tip or an engaged weight therebetween.

An additional object of the invention is to provide additional draw length at the front of the arrow shaft.

A further object of the invention is the provision of such a mount which resists damage to the arrow shaft and improves arrow rotation during flight.

While all of the fundamental characteristics and features of the disclosed arrow shaft mount for a carbon fiber arrow shaft have been described herein, with reference to particular embodiments thereof, a latitude of modification, various changes and substitutions are intended in the foregoing disclosure and it will be apparent that in some instance some features of the invention will be employed without a corresponding use of other features without departing from the scope of the invention as set forth.

BRIEF DESCRIPTION OF DRAWING FIGURE

DETAILED DESCRIPTION OF THE PREFERRED EMBODIMENTS OF THE INVENTION

Figure 1:
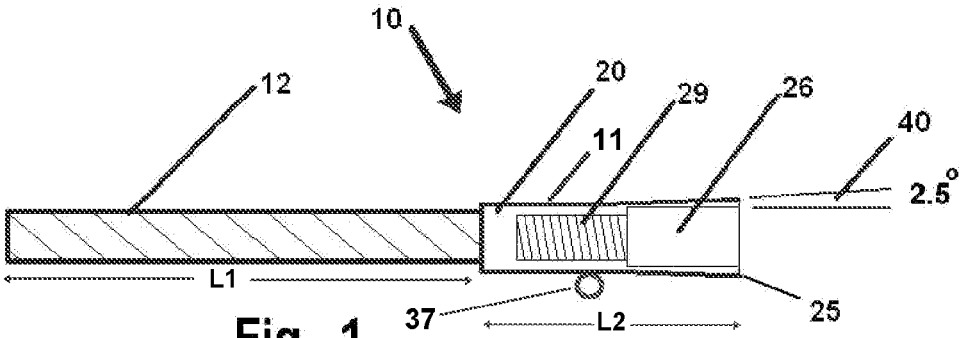
FIG. 1 depicts a side view of one mode of the device prior to insertion of its elongated member into the axial bore of an arrow shaft.

Referring now to FIGS. 1-14 where similar parts are identified by like reference numerals which may be found in one or more of the drawings, there is seen in FIG. 1, a sectional view through the center of the device 10. The device 10 is preferably of a high strength material such as titanium, stainless steel, or aluminum alloy, or similar material known in the art. Currently, experimentation has found that titanium yields a preferred characteristic in that the device 10 formed thereof is lightweight, but has a significant improvement in strength over aluminum and aluminum alloys.

The device 10 features an elongated mounting member 12 which extends in a first direction and has a diameter and resulting exterior circumference adapted to be substantially equal to, or slightly smaller, than the inside circumference of an axial bore 14 (FIG. 3) of the intended carbon fiber or similar arrow shaft 16.

Engagement of the elongated mounting member 12 within the arrow shaft 16 axial bore 14 may be achieved by friction, mechanical, or other means of engagement as would occur to those skilled in the art. Currently however, adhesive 18 is the favored mode of engagement as it yields a strong, slightly flexible permanent bond and mount for the device 10.

In a particularly preferred mode of the device 10, the elongated member 12 is adjusted in length to provide the desired amount of weight to the assembled arrow. The rearward projection of the elongated mounting member 12, also provides a stabilizing of the device 10 in its engagement to the arrow shaft 16 on an impact by resisting rotation of the device 10 in its engagement using the leverage of the axially engaged mounting member 12 to hold the body 11 secure at the end of the arrow shaft 16. The member 12 being axially aligned with the center axis of the arrow shaft 16 and having the leverage to resist the forces of hard impacts of the arrow head, also maintains the body 11 aligned with the leading end of the arrow shaft 16. This causes the force of an impact to be evenly transmitted down the circular wall forming the arrow shaft 16. This even transmission eliminates the buckling and bending caused by collared engagements, and the shearing of the wall of the shaft 16 caused when the uneven forces rotate the collared engagement.

The member 16 extending from the body 11 as shown in FIG. 1, has length L1 which is longer than the length of the body 11 portion L2, from which it extends. Currently, the ratio of L1 to L2 is substantially 3 to 1, however this may be adjusted as needed. Currently a preferred range of L1 to L2 is having L1 at a minimum substantially equal to L2, and while there is no maximum, the current preferred maximum is having L1 four times L2 since anything longer would over weight the arrow an serve no additional purpose in stabilizing and maintaining the forces aligned on an impact.

Preferred currently however in all modes of the device 10, the member 12 length L1 is longer than that of the body 11 portion of the device L2 from which it extends. Further, the extension of the member 12 into the axial bore 14 provides a means to increase the rigidity of the leading end of the arrow shaft 16 so engaged, align the impact forces with the wall forming the arrow shaft 16, and thereby resist splintering, shearing, and bending on impact as occurs with collared engagement components of prior art.

The exterior surface of the member 12 is best made non-smooth, such as grooved or gnarled, to aid in adherence of the adhesive between the member 12 and the shaft 16. The member 12 when employed with adhesive, should have a diameter slightly smaller than the diameter of the axial bore 14 of such carbon fiber arrows 16 to allow for smooth insertion and to leave room for adhesive to bind the two together.

The member 12 extends from a first end of the body 11 or from the shoulder portion 20 of the body 11 of the device 10 which has a diameter larger than the member 12. In a preferred mode of the device 10, the shoulder portion 20 or the first end of the body 11, should be formed to have an exterior circumference, substantially equal to the exterior of the arrow shaft 16. This provides a stop for the member 12 of the shoulder portion 20 of the body 11 against the front edge of the wall forming the arrow shaft 16, and a smooth aerodynamic exterior to the assembled arrow. If the shoulder 20 is present, it provides a support area for an arrow rest forward of the leading end of the shaft 16.

Figure 2:
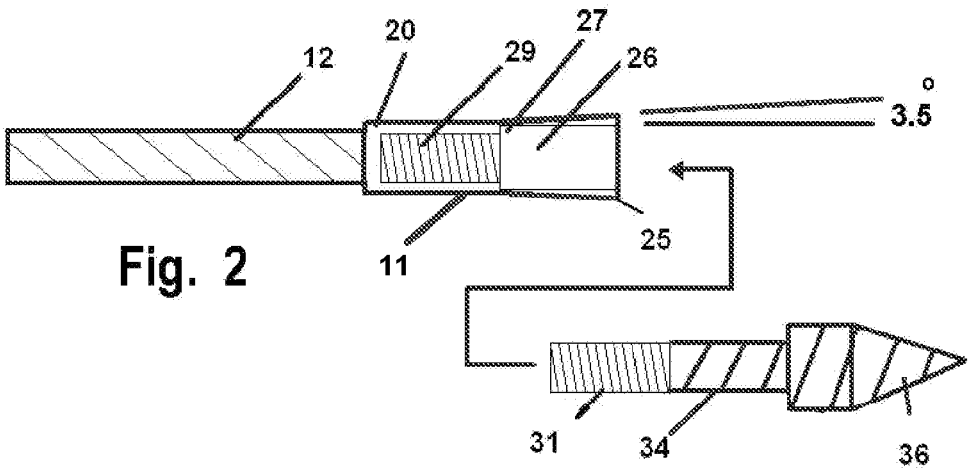
FIG. 2 shows another mode of the device with a steeper taper and a conventional arrow point staged for threaded engagement therewith.

At a second end of the body 11, opposite the first end or shoulder portion 20, an axial passage 26 is formed within the device 10 and communicates with the opposite end of the device 10 from that of the member 12 through a formed aperture. The entire axial passage 26 may be threaded, or to allow quick insertion of conventional arrowhead mounting shafts 34, alternatively a first portion 27 of the axial passage 26 from the aperture access to a mid point is smooth walled and the second portion 29 between the member 12 and the first portion 27 is threaded. The threads 31 of the axial passage 26 are configured to engage matching threads 31 formed on the leading end of the mounting shaft 34 extending from the mount of an arrow tip 36 as shown in FIG. 2. So configured, the tip 36 may be engaged to the conventionally and widely used arrow shaft 16 in a threaded attachment to the device 10 allowing for easy engagement and removal.

Particularly preferred in all configurations of the disclosed mount device 10, is an exterior diameter circumferential taper 40. This taper 40 may initiate from a mid portion of the mount device 10 between the front 25 and the shoulder 20 and taper outwardly at an even rate to form a tapered leading end of the body 11 of the mount device 10 having a circumference substantially equal to the exterior circumference of the mount for the tip or arrowhead. Currently, this taper is between 2.5 to 3.5 degrees as shown but could vary depending upon the components the device is sandwiched in-between.

Figure 3:
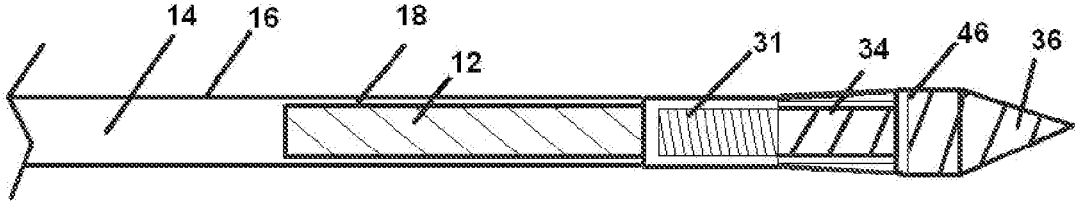
FIG. 3 shows the device of FIG. 1 or FIG. 2 in the engaged position upon the leading end of an arrow shaft, and with the tip threadably engaged to the disclosed device.

The body 11 of the device 10 sandwiched between the arrow shaft 16 and the tip 36 using this partially tapered exterior, provides a smooth aerodynamic transition between components as shown in FIG. 3. Further, the shoulder 20 has a circumference matching that of the arrow shaft, and this allows the user to support the assembled arrow in an engagement of the arrow rest 37 on the shoulder 20 if desired. This means of support for the arrow rest 37 allows the arrow to be drawn further rearward if desired, or the arrow shafts to be cut shorter if desired by the archer.

For fine adjustment of the mass or weight of the arrow so formed, removable donut shaped weights 46 may be employed sandwiched between the rear edge of the tip 36 and front edge 33 of the body 11 of the device 10 and slidable engaged upon the mounting shaft 34.

Figure 4:
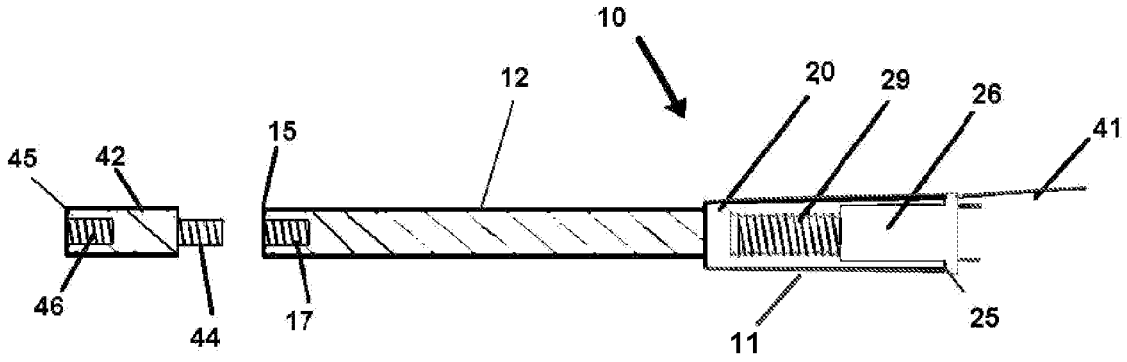
FIG. 4 shows the device in another particularly preferred mode wherein additional members are removably engageable to the elongated member and the taper extends from the front aperture to the shoulder of the device.

For additional fine adjustment of the mass or weight as previously mentioned the elongated member 12 may be adjusted in length L1 and weight by removable engagement of additional elongated member portions 42 employing a means for removable engagement in another particularly preferred mode of the device as shown in FIG. 4. The means for removable engagement of the additional member portions 42 to the elongated member 12 can be any means known in the art but it is presently particularly preferred that the elongated member 12 includes a threaded aperture 17 extending from the distal end 15 along the length of the member 12. The threaded aperture 17 is employed to operatively engaged an extending threaded portion 44 of the additional member 42.

A user may selectively add or remove additional members 42 to the elongated member portion 12 as desired for weight adjustment. As such the additional member portions 42 may include a threaded aperture 46 extending from the distal end 45 for operative removable engagement with a plurality of such member portions 42. It must be noted that this mode may be employed separately or in combination with any of the preferred modes of this disclosure.

Further shown in FIG. 4 is another particularly preferred mode of the exterior diameter taper 41 extending from the rear of the shoulder 20 of the body 11 of the device 10, to the front 25 edge as opposed from the midpoint to the front 25 as previously disclosed. This mode of the taper 41 provides added mass and users not desiring the surface for the bow arrow rest may prefer it. However, the taper in either mode provides for smooth passage through the air in flight. It must again be noted that both the provision of an exterior taper 41 extending from the shoulder 20 to the front 25 or the entire length of the body 11, may be employed separately or in combination with any of the preferred modes and components noted herein, and should not be considered limiting by the depiction.

Figure 5:
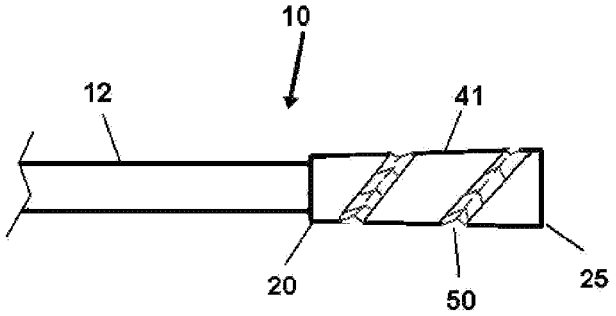
FIG. 5 is a side view of the device showing right or left handed flutes formed on the exterior surface of the device for aiding and inducing spin to the flying arrow.

Aerodynamics and spin of an arrow greatly affect the flight speed and distance achieved by the arrow. Typically, the fletching at the tail end of the arrow shaft, which is traditionally made of feathers, provides a means to stabilize by inducing a spin on the arrow during flight for improved accuracy and distance. To aid in the induced spin of the arrow, one mode of the device 10 provides a means to add to the rotation or spin of the assembled arrow and device 10 herein. There is seen in FIG. 5 a side view of the device 10 wherein the exterior surface along the tapering exterior surface 41 includes air-reactive formations, such as by engraving or the depicted slotted recesses 50 which form left or right handed flutes. The recesses 50, or projections, provide a means for inducing spin to the arrow during flight, aiding the rearward mounted feathers. The left or right handed pitch of the formed recesses 50, as well as frequency of convolution may vary to provide the desired rotational force and as desired by a user.

Figure 6:
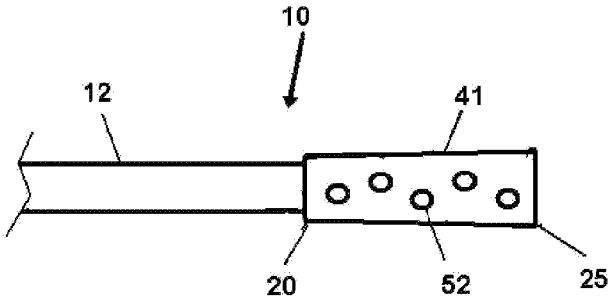
FIG. 6 is a side view of the device with dimples disposed on the exterior surface of the device for increase lift and improved aerodynamics.

In all modes of the device 10, increased aerodynamics may be achieved through the provision of operatively positioned dimples 52 employed on the tapering exterior surface 41 as in yet another particularly preferred mode shown in FIG. 6. The dimples 52 essentially provide aerodynamics similar to that of a golf ball and may be formed on the device 10 by any means known in the art for forming dimples 52.

It should be noted, and those skilled in the art will realize, that the modes of the device 10 disclosed in FIGS. 5 and 6 with spin inducing recesses 50 (or projections) and dimples 52, may be operatively employed separately or in combination with any of the preferred modes previously disclosed, and along either the partially angled exterior of FIGS. 1-3 or the fully angled exterior of FIG. 4.

Figure 7:
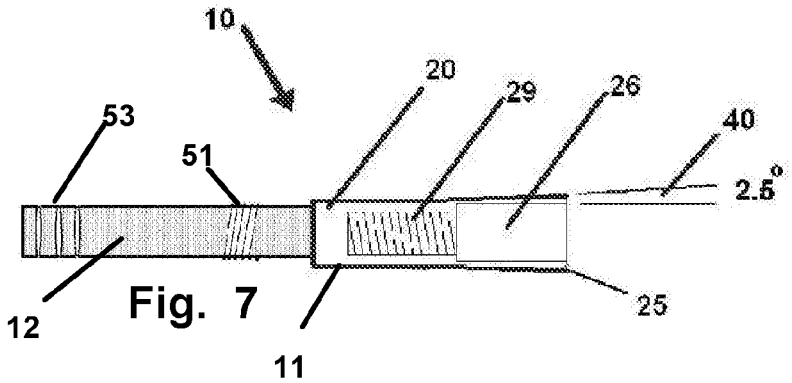
FIG. 7 depicts a mode of the device showing the insert having recesses and/or threads positioned on the elongated member extending from the tapering circumference of the body portion narrowing from the distal end toward the elongated member end.
Figure 8:
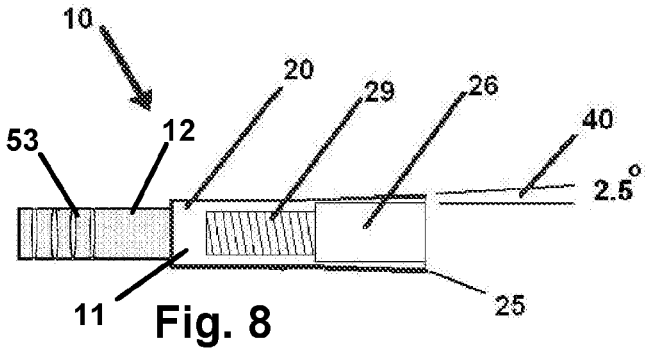
FIG. 8 depicts a mode of the device where the insert has a shorter elongated member and includes recesses with for better engagement of the adhesive between the arrow shaft and member.
Figure 13:
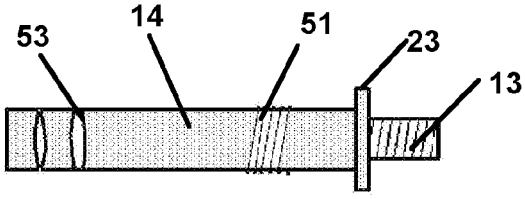
FIG. 13 shows the elongated member adapted to engage any body and having one or both of recesses and threads thereon to engaged the arrow shaft interior.
Figure 14:
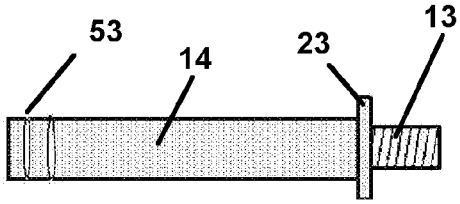
FIG. 14 depicts a mode of the device of FIG. 13 showing only the recesses formed on the elongated member.

In FIGS. 7 and 13 are shown a modes of the device 10 showing the mounting member 12 formed to have a circumference substantially equal to or slightly larger than, the axial passage axial bore 14 of a arrow shaft 16. By substantially equal to is mean equal to or between ten thousandths of an inch less or ten thousandths of an inch more than the axial bore 14. Shown are threads 51 and recesses 53 positioned on the mounting member 12. The mounting member 12 may have either of, or both of the threads 51 and recesses which aid in engagement of the device 10 to an arrow shaft 16.

With the axial circumference of the mounting member 12, in the area of the threads 51, being between 1-3 thousandths of an inch larger than the circumference of the axial bore 14 of the shaft 16, it has been found through experimentation that in all modes of the device 10 be they one or two piece, that threads 51 once cut, extend very slightly into the wall surface of the shaft 16, and enhance engagement thereto of the device 10. The projection of the threads 51 from the circumference of the mounting member 12, which should be equal to or slightly less than the circumference of the axial bore, should not extend more than 10 thousandths of an inch beyond the circumference of the bore 14, and preferably no more than 2-3 thousandths of an inch into the wall of the shaft 16.

As depicted in FIGS. 7, 8, 13, and 14, the recesses 53 formed in the mounting member 12 have been shown to enhance engagement of the adhesive with the member 12 and the wall of the axial bore 14 of the arrow shaft 16. Used alone or on combination with the threads 51 in all modes of the one or two piece device 10 enhanced engagement has been found especially where the shaft 16 is formed of composite material which may slightly flex on impact of the arrow with a target.

Figure 9:
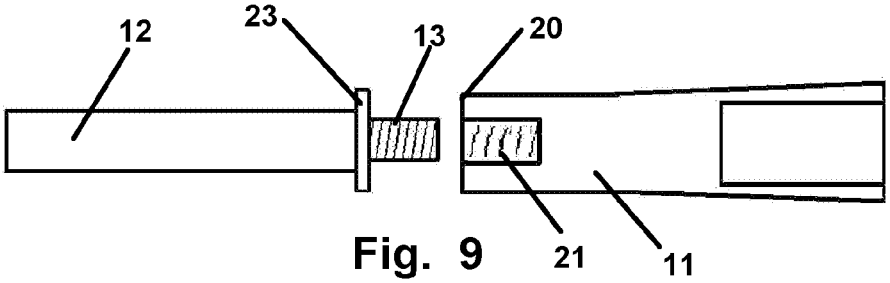
FIG. 9 depicts a two-piece mode of the device herein wherein the body engages a projecting threaded or otherwise engageable member extending from the elongated member.

FIG. 9 depicts a mode of the device 10 where the body 11 is removably engageable to the mounting member 12. Means for engagement of the body 11 to the mounting member 11, may be a frictional engagement such as forming a projecting mount 13 a few thousandths of an inch larger in diameter than the diameter of a mounting passage 21 and inserting the cooled projecting mount 13 into the warmed or heated mounting passage 21. Of course the projecting mount 13 might project from the body 11 into the mounting passage 21 formed axially into the elongated member 12 in all modes herein, however the depicted mode is preferred as it has shown in experimentation to be stronger on impact.

Currently, a threaded engagement as shown in FIGS. 9-12 has shown to provide an excellent connection between the body 11 and the mounting member 12 to form the device 10. The diameter of the mount 13 with threads should be at least 25% of the diameter of the body 11 at the shoulder 20 and preferably between 25-75% thereof depending on the metal being employed for formation of both the body 11 and the mounting member 12 and mount 13 which should be formed as a unitary structure with the mounting member 13.

Formation of the device 10 in a two component configuration still employs a body 11 and trailing mounting member 12 as in the modes shown in FIGS. 1-8, but allows for the body 11 and the mounting member 12 to be formed independently and weighted differently for balancing the formed arrow, and also in some modes may be less expensive where the mounting member 12 may be formed of a stronger material such as titanium, and the body 11 formed of aluminum. In all modes of the two piece mode of the device 10 any configuration of the exterior of the mounting member 12 may be employed with the results noted above for differing configurations.

Figure 10:
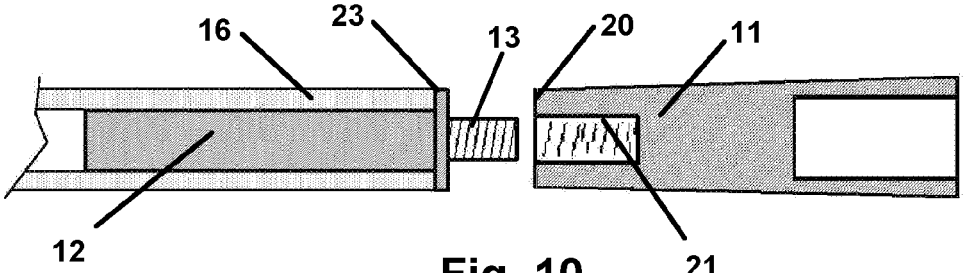
FIG. 10 depicts the two-piece mode of FIG. 9 with the elongated member in an engaged position with an arrow shaft.
Figure 11:
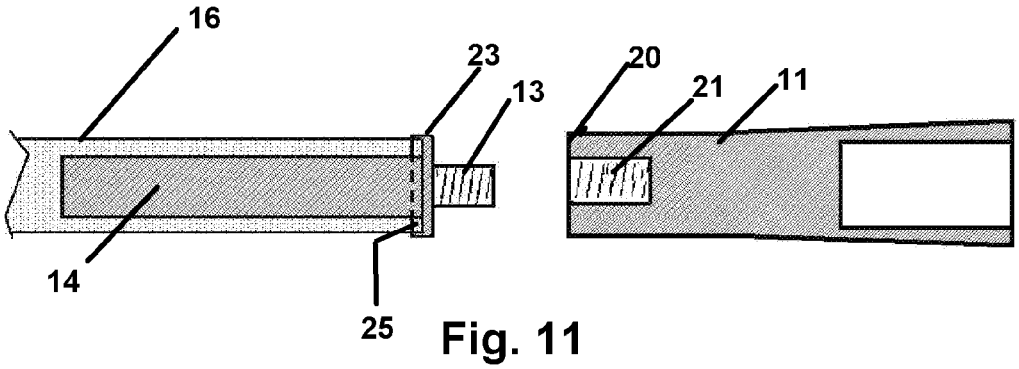
FIG. 11 depicts a version of the two piece mode where a collar is positioned in between the elongated member and the extending engageable shaft to surround the exterior of the arrow shaft.
Figure 12:
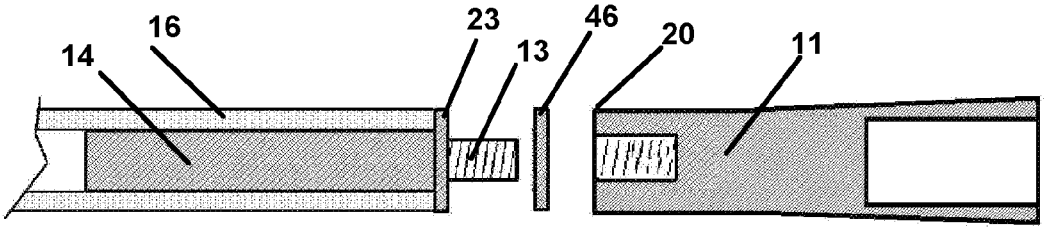
FIG. 12 shows a mode of the two piece device where it may be weighted.

Some favored configurations of the device 10 where the body 11 is engageable to the mounting member 12 are depicted in FIGS. 10-12. As can be seen in FIG. 10, the two-piece mode such as shown in FIG. 9 is engageable by insertion of an elongated mounting member 12 into an engaged position within the axial bore 14 of an arrow shaft 16. In FIG. 10, the mounting member 12 is shown engaged with the arrow shaft 16 and has a member shoulder 23 configured to contact the edge of the arrow shaft 16 on a first surface, and the shoulder 20 of the body 11 once engaged to the member 12 using means for engagement such as threads on the mounting member 13 and an axial mounting passage 21 in the body 11.

In FIG. 11 is shown version of the device 10 where a the member shoulder 23 has a recess 25 formed on the side of the member shoulder 23 facing the arrow shaft 16 when the device 10 is engaged as in FIG. 11. The member shoulder 23 should still have a diameter which is equal to or preferably slightly exceeds that of the diameter of the arrow shaft 16 to maximize the contact of the surface of the shoulder 23 with the shaft 16 end. The recess 23 has a width substantially equal or slightly more or less than the wall thickness of the shaft 16 and when slidably engaged thereon, thereby forms a retaining collar which surrounds the circumference of the arrow shaft 16 at its communication with the member shoulder 23. The surrounding portion defined by the recess 25 need not have a large width to provide the means circumferential support, however it is preferred that the surface of the shoulder 23 at contact with the arrow shaft 16 have a circumference equal to or slightly larger than the circumference of the arrow shaft 16. In the two-piece mode of the device 10, this inclusion of a recess 25 has been shown in experimentation to provide reinforcement to the wall of the arrow shaft 16 from spreading when the member shoulder 23 is sized as noted and during high speed impacts of the formed arrow.

FIG. 12 shows a mode of the device 10 where a weight 46 may be engaged between the member shoulder 23 and the shoulder 20 of the body 11 during assembly. This sandwiched engagement of the weight 46 provides a very secure mount, and this configuration of the two piece mode of the device 10 allows the user to place heavier and lighter weights 46 on the assembled arrow to increase mass or balance the formed arrow and arrowhead.

FIG. 13 and are depicted for clarity and shows the elongated member 12 of the device 10 ready for an engagement to a properly configured body 11 as disclosed above, and having a member shoulder 23 formed in-between the elongated member 12 on one side and the mount 13 on the other. The circumference of the member shoulder 23 is substantially equal to the circumference of the shoulder 20 of the body 11 whether the declining taper extends all the way to the body shoulder 20 or to a point between the body shoulder 20 and the front of the body 11. The recesses 53 and the threads 51, shown may be employed singularly or together depending on the strength of the engagement between the device 10 and the arrow shaft 16 desired.

While all of the fundamental characteristics and features of the disclosed arrow tip mounting device for carbon fiber and synthetic arrow shafts have been disclosed with reference to particular embodiments thereof, a latitude of modification, various changes and substitutions are intended in the foregoing disclosure. Further, it will be apparent that in some instance, some features of the invention may be employed without a corresponding use of other features without departing from the scope of the invention as set forth. It should be understood that such substitutions, modifications, and variations as may be made by those skilled in the art, without departing from the spirit or scope of the invention, are included within the scope of the invention as defined herein by the claims that follow.

What is claimed is:

1. An arrow tip engagement apparatus for operative positioning at a leading end of an arrow shaft, comprising:

a body, said body having a center axis and having a diameter determining an exterior circumference, said body extending from a first end to a second end;

said first end of said body adapted for an engagement with an arrowhead;

said second end of said body adapted for an attachment at a first end of an elongated member to an engaged position therewith;

said elongated member in said engaged position, extending away from said second end of said body along said axis, said member extending a distance to a distal end of said elongated member;

said elongated member adapted for an operative engagement within an axial bore of an arrow shaft; and a narrowing of said exterior circumference of said body, said narrowing extending from a larger said exterior circumference at or adjacent to said first end, to a narrowed said exterior circumference a distance away from said first end toward said second end, whereby said elongated member in said attachment to said body, is positionable to said operative engagement with said axial bore of said arrow and said first end of said body is engageable with a said arrow head to position it at said leading end of said arrow shaft.

2. The arrow tip engagement apparatus of claim 1, wherein said narrowing of said exterior circumference of said body, extending from a larger said exterior circumference at or adjacent to said first end, to a narrowed said exterior circumference, is comprised of a taper of said exterior circumference of said body.

3. The arrow tip engagement apparatus of claim 2, additionally comprising:

said elongated member extending along said axis from a said attachment with said second end of said body, having a member circumference which is narrower than said exterior circumference of said body at said second end; and said first end of said elongated member, or said second end of said body, configured for a mating with said leading end of said arrow.

4. The arrow tip engagement apparatus of claim 3 wherein said first end of said body adapted for an engagement with an arrowhead comprises:

an axial cavity formed in said first end of said body along said axis, said axial cavity defined by a sidewall; and a portion of said sidewall having threads formed therein, said threads being formed complimentary to threads positioned upon threaded shaft projecting from said arrowhead.

5. The arrow tip engagement apparatus of claim 2 wherein said first end of said body adapted for an engagement with an arrowhead comprises:

an axial cavity formed in said first end of said body along said axis, said axial cavity defined by a sidewall; and a portion of said sidewall having threads formed therein, said threads being formed complimentary to threads positioned upon threaded shaft projecting from said arrowhead.

6. The arrow tip engagement apparatus of claim 2 wherein said second end of said body adapted for an attachment at a first end of an elongated member to an engaged position therewith using means for engagement, comprising:

a mount extending along said axis, said mount extending from said first end of said elongated member in a direction opposite from said distal end; and said mount configured for engagement with a mating component positioned on said second end of said body.

7. The arrow tip engagement apparatus of claim 6, additionally comprising:

said first end of said elongated member configured for a mating with said leading end of said arrow by a shoulder portion;

said shoulder portion extending radially from said circumference of said elongated member at said first end thereof;

said shoulder having a first side surface sized for contact with said leading end of said arrow; and said mount extending from a second surface of said shoulder portion opposite said first surface.

8. The arrow tip engagement apparatus of claim 7, additionally comprising:

a recess formed in said first side surface; and said recess sized for insertion of a sidewall forming said arrow shaft therein.

9. The arrow tip engagement apparatus of claim 8, additionally comprising:

said mount extending along said axis in said direction opposite from said distal end being a threaded projection; and said mating component positioned on said second end of said body being an aperture having threaded a threaded sidewall.

10. The arrow tip engagement apparatus of claim 7, additionally comprising:

said mount extending along said axis in said direction opposite from said distal end being a threaded projection; and said mating component positioned on said second end of said body being an aperture having threaded a threaded sidewall.

11. The arrow tip engagement apparatus of claim 6, additionally comprising:

said mount extending along said axis in said direction opposite from said distal end being a threaded projection; and said mating component positioned on said second end of said body being an aperture having threaded a threaded sidewall.

12. The arrow tip engagement apparatus of claim 1, additionally comprising:

said elongated member extending along said axis from a said attachment with said second end of said body having a member circumference which is narrower than said exterior circumference of said body at said second end; and said first end of said elongated member or said second end of said body, configured for a mating with said leading end of said arrow.

13. The arrow tip engagement apparatus of claim 12 wherein said first end of said body adapted for an engagement with an arrowhead comprises:

an axial cavity formed in said first end of said body along said axis, said axial cavity defined by a sidewall; and a portion of said sidewall having threads formed therein, said threads being formed complimentary to threads positioned upon threaded shaft projecting from said arrowhead.

14. The arrow tip engagement apparatus of claim 1 wherein said first end of said body adapted for an engagement with an arrowhead comprises:

an axial cavity formed in said first end of said body along said axis, said axial cavity defined by a sidewall; and a portion of said sidewall having threads formed therein, said threads being formed complimentary to threads positioned upon threaded shaft projecting from said arrowhead.

15. The arrow tip engagement apparatus of claim 1 wherein said second end of said body adapted for an attachment at a first end of an elongated member to an engaged position therewith using means for engagement, comprising:

a mount extending along said axis, said mount extending from said first end of said elongated member in a direction opposite from said distal end; and said mount configured for engagement with a mating component positioned on said second end of said body.

16. The arrow tip engagement apparatus of claim 15, additionally comprising:

said first end of said elongated member configured for a mating with said leading end of said arrow by a shoulder portion;

said shoulder portion extending radially from said circumference of said elongated member at said first end thereof;

said shoulder having a first side surface sized for contact with said leading end of said arrow; and said mount extending from a second surface of said shoulder portion opposite said first surface.

17. The arrow tip engagement apparatus of claim 16, additionally comprising:

a recess formed in said first side surface; and said recess sized for insertion of a sidewall forming said arrow shaft therein.

18. The arrow tip engagement apparatus of claim 17, additionally comprising:

said mount extending along said axis in said direction opposite from said distal end being a threaded projection; and said mating component positioned on said second end of said body being an aperture having threaded a threaded sidewall.

19. The arrow tip engagement apparatus of claim 16, additionally comprising:

said mount extending along said axis in said direction opposite from said distal end being a threaded projection; and said mating component positioned on said second end of said body being an aperture having threaded a threaded sidewall.

20. The arrow tip engagement apparatus of claim 15, additionally comprising:

said mount extending along said axis in said direction opposite from said distal end being a threaded projection; and said mating component positioned on said second end of said body being an aperture having threaded a threaded sidewall.

* * * * *